United States Patent [19]

Odermann et al.

[11] 4,183,313

[45] Jan. 15, 1980

[54] SEWING MACHINE CASSETTE THREADING SYSTEM

[75] Inventors: Charles R. Odermann, Lake Valhalla; William L. Herron, Elizabeth, both of N.J.

[73] Assignee: The Singer Company, New York, N.Y.

[21] Appl. No.: 969,612

[22] Filed: Dec. 14, 1978

[51] Int. Cl.[2] ..... D05B 43/00

[52] U.S. Cl. ..... 112/302

[58] Field of Search ..... 112/169, 259, 302; 242/137.1, 138, 137, 55.19 A

[56] References Cited

U.S. PATENT DOCUMENTS

| | | | |
|---|---|---|---|
| 2,686,484 | 8/1954 | Cuthbertson | 112/302 |
| 3,122,113 | 2/1964 | Edwards | 112/302 |
| 3,749,039 | 7/1973 | Fritts | 112/302 |
| 4,070,977 | 1/1978 | Yamamoto et al. | 112/259 |

*Primary Examiner*—Werner H. Schroeder
*Assistant Examiner*—Andrew M. Falik
*Attorney, Agent, or Firm*—Robert E. Smith; Edward L. Bell; Michael H. Wallach

[57] ABSTRACT

A sewing machine cassette threading system in which the thread handling instrumentalities of a sewing machine are arranged to accept thread from either a cassette or a conventional thread spool with a minimum of operator intervention. The sewing machine has a chamber formed therein to accept the cassette. The sewing machine thread handling instrumentalities are threaded by inserting a cassette into a cover enclosing the chamber and closing the cover. Thread from a conventional spool carried on the sewing machine arm may be placed in the cover for insertion into the thread handling instrumentalities when the cover is closed.

4 Claims, 8 Drawing Figures

SEWING MACHINE CASSETTE THREADING SYSTEM

BACKGROUND OF THE INVENTION

1. Field of the Invention

This invention relates to sewing machines having a means for interchangeably using a cassette containing a supply of thread or a spool of thread for the thread supply.

2. Description of the Prior Art

Most sewing machines have heretofore been supplied with thread from a spool carried on the arm of the sewing machine. Sewing machines employing thread supplied from conventional spools are frequently difficult or confusing to thread due to the complexity of the path that must be followed to insure that the thread is engaged into the requisite thread handling instrumentalities in the proper order. While contemporary sewing machines have become increasingly easy to operate, there still remains the problem of accurate threading to insure precise stitch formation. The problem becomes even more acute when thread must be changed frequently to accommodate a new color or thread type demanded by a particular sewing situation.

One problem with prior threading systems is that they did not allow the interchangeable use of a cassette containing a supply of thread, or a spool of thread to supply the thread demands of the needle.

Another problem is that prior known thread cassettes were excessively complicated, thus contributing to prohibitive manufacturing costs.

Still another problem is that some prior known sewing machines adapted for thread cassette operation would not operate successfully unless the main shaft was rotated to a predetermined position prior to insertion of the cassette.

SUMMARY OF THE INVENTION

It is an object of this invention to provide a sewing machine which can operate successfully with thread supplied from either an easily inserted cassette or a conventional spool of thread.

Another object is to provide a sewing machine in which insertion of the cassette accomplishes the threading of the thread handling instrumentalities with a minimum of operator intervention.

Still another object is to provide a disposable thread cassette which may be manufactured at low cost.

The above objects and other advantages are provided by a sewing machine having a chamber into which a cassette containing thread may be introduced. The chamber is provided with a cover which aligns the cassette relative to thread handling instrumentalities located within the chamber. The cassette contains two spaced legs which are traversed by a length of thread which is engaged by a tension member and a check spring. The arm of the sewing machine also contains a thread accommodating slot through which thread from a spool carried exteriorly to the chamber may pass to the thread handling instrumentalities contained within the chamber. Thread guides carried on the cover insure that thread placed thereon from an external spool will be properly engaged by the thread handling instrumentalities.

DESCRIPTION OF THE DRAWINGS

The above and other objects of this invention will become evident from a full and complete understanding of the preferred embodiment which is hereinafter set forth in such detail as to enable those skilled in the art to readily understand the function, operation, construction and advantages of it when read in conjunction with the accompanying drawings in which.

DESCRIPTION OF THE PREFERRED EMBODIMENT

Figure 1:
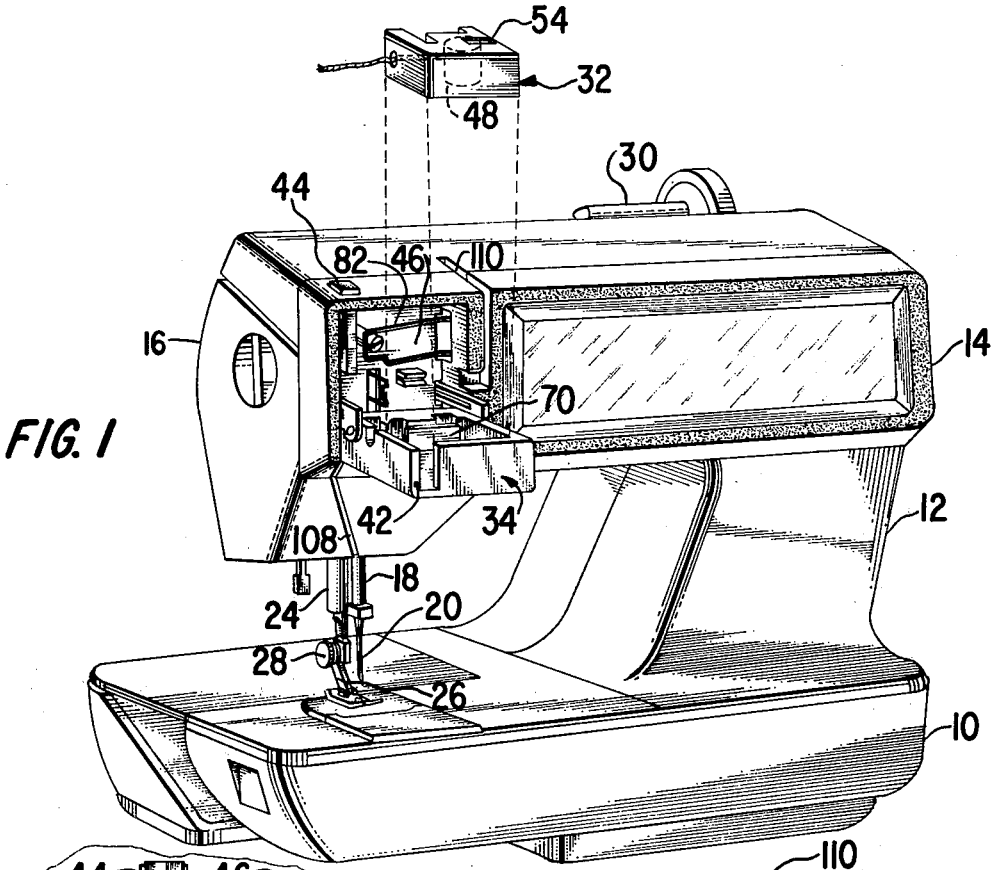
FIG. 1 is a perspective view of a sewing machine having a cassette threading system constructed in accordance with the teachings of this invention incorporated therein.

Referring to the drawings, FIG. 1 shows a sewing machine having a base 10. A standard 12 rises from the base 10 and supports a bracket arm 14 which overhangs the base 10 and terminates in a sewing head 16. Journalled in the sewing head 16 for endwise reciprocatory motion toward and away from a stitch forming area on the base 10 is a needle bar 18 to which is fastened a thread carrying stitch forming instrumentality shown as the needle 20 which carries a needle thread 22 which is consumed during the well known process of forming lockstitches. A presser bar 24 is also journalled in the sewing head and has a presser foot 26 attached thereto with a suitable clamp means, as for example, with a screw 28. The presser foot 26 acts to contain the work piece against the thrust of a feed dog (not shown) which moves the fabric past the needle 20 in a well known manner which need not be recited for a full and complete understanding of the disclosed invention.

A sewing machine constructed in accordance with the teachings of the present invention may be supplied with thread from either a spool (not shown) carried on a spool holder 30 which is fastened to the rear of the bracket arm 14 or by a thread cassette which is shown generally at 32. It will be seen from FIG. 1 that means for accommodating and shifting the cassette relative to the sewing machine are provided by a cover 34 which is hingedly fastened to the front of the arm by a set of pins 36 and a pair of brackets 38. The cover 34 is secured against the arm 14 in a substantially upright or closed position by a latch member 40 which engages an aperture 42 formed in the cover 34 and which may be operated by depressing a cover release button 44 preferably carried on the arm 14.

The arm 14 contains a chamber 46 into which the cover 34 may be rotatably pivoted and which contains a plurality of thread handling instrumentalities which influence the control of the thread as it is removed from the thread supply. The cover 34 has a window 47 through which the quantity of thread remaining in the cassette 32 may be observed.

Figure 2:
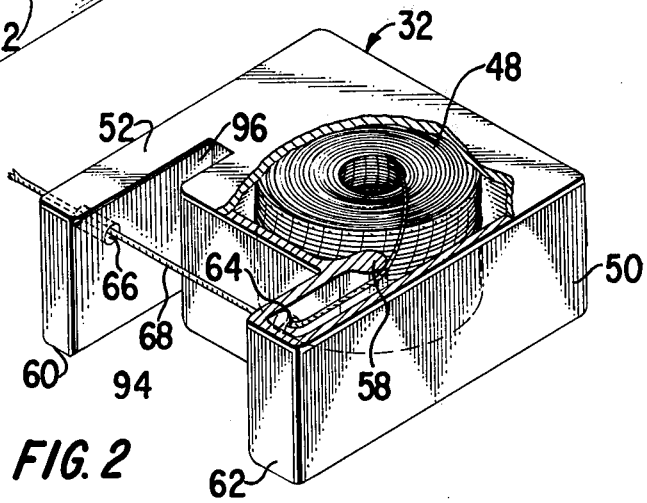
FIG. 2 is a perspective view of a thread cassette containing a supply of thread which may be used during the sewing process.

FIG. 2 shows that the thread cassette 32 contains a thread supply 48 which is preferably formed in a coil shape with the thread end supplied to the needle 20 being removed from the center of the coil to provide for a large volume of thread without creating an excessive load which would be created if the whole thread mass was rotated as a conventional thread spool or bobbin. The cassette 32 is preferably formed from an easily molded material, as for example, plastic. Preferably the cassette 32 is formed with a body 50 and a top 52 which permits the cassette 32 to be easily filled with thread before enclosing the body 50 with the top 52. The top 52 has formed thereon a window 54 through which the color and quantity of thread remaining in the cassette 32 may be observed, and a similar window 56 is formed on the bottom to permit observation of the remaining thread quantity through the window 47 contained in the cover. Preferably formed within the body of the cassette 32 is a hub 58 which supports the thread supply 48 and insures the smooth removal of the thread from the cassette 32. The cassette 32 has a first leg 60 and a second leg 62 which provide a means for guiding thread from the cassette 32 in at least one free span and which are spaced apart to provide clearance for the thread handling instrumentalities contained within the chamber 46. One extremity of the thread supply extends through an aperture 64 contained in the second leg 62 and through an aperture 66 contained in the first leg 60 to form a free span of thread 68 supported therebetween. The free span of thread 68 is available for engagement by the thread handling instrumentalities contained within the chamber 46 when the cover 34 is rotated into its closed position within the arm 14.

Figure 3:
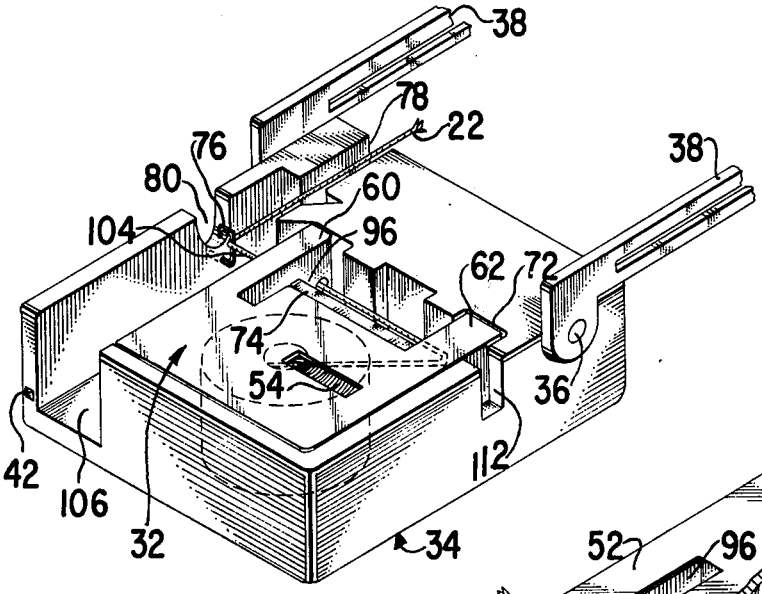
FIG. 3 is a perspective view of a cover having a thread cassette inserted therein.

FIG. 3 best illustrates how the thread cassette 32 is retained within a cassette accommodating chamber 70 formed in the cover 34. The chamber 70 has a second leg accommodating slot 72 which is located to preclude the improper insertion of the cassette 32 into the chamber 70. Preferably the cover 34 also has formed thereon a support block 74 which extends into the chamber 70 and which resides between leg 60 and leg 62 of the cassette 32. The cover 34 has a thread guide 76 preferably fastened to one wall thereof, which may be used to direct thread from the cassette 32 to a thread passageway 78 which is formed in the cover 34. A slot 80 is formed on one wall of the cover adjacent to the guide 76 to facilitate easy threading of the guide 76 by a sewing machine operator.

Figure 5:
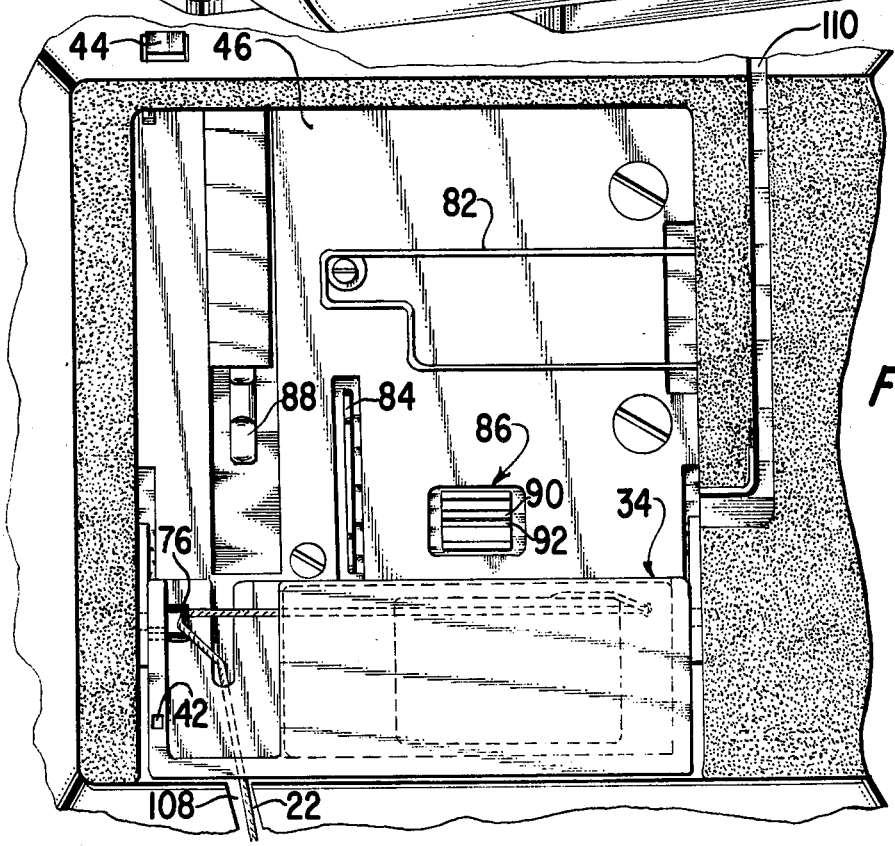
FIG. 5 is an enlarged front view of a portion of FIG. 4 showing the thread handling instrumentalities.
Figure 4:
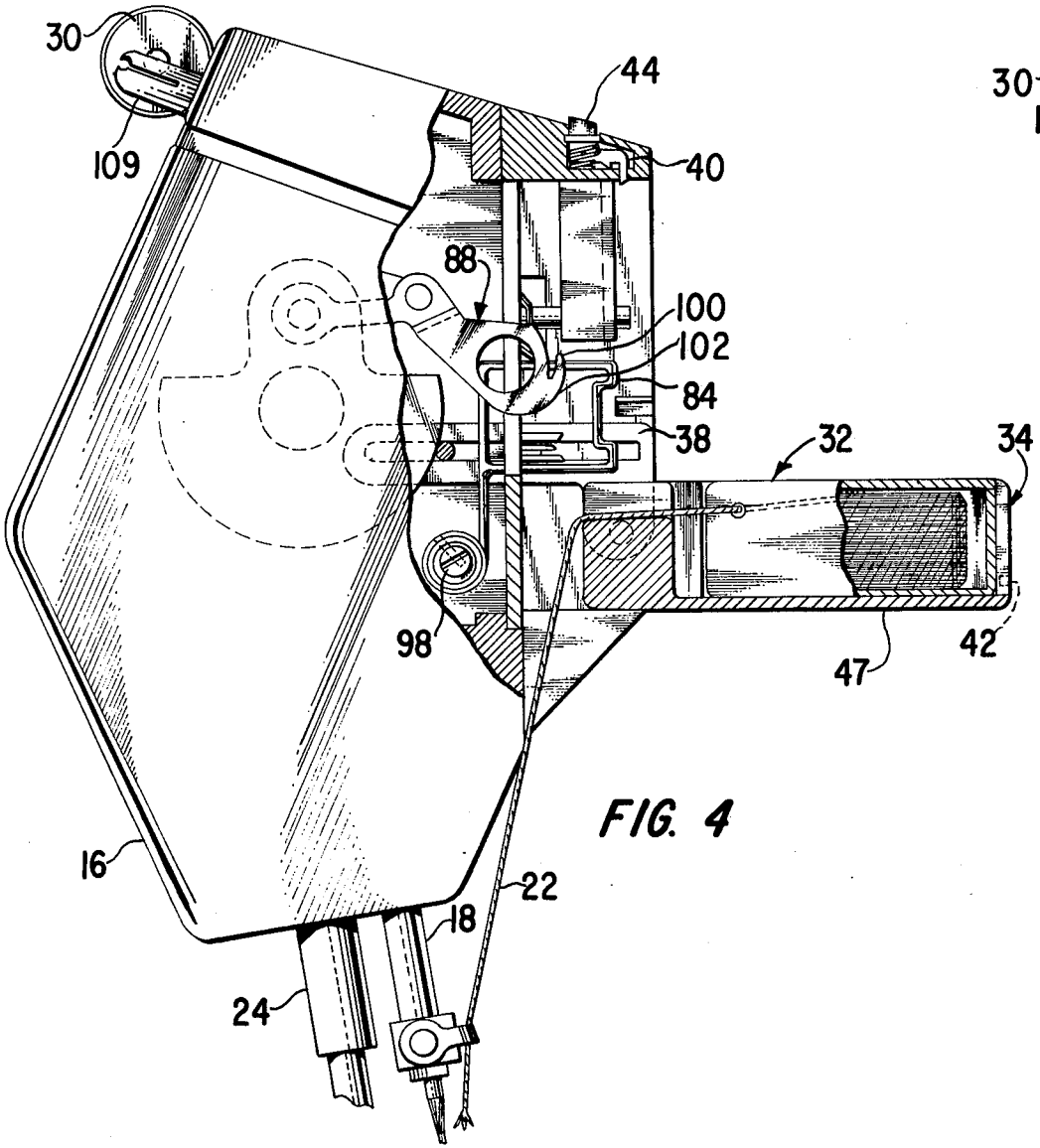
FIG. 4 is a cutaway end view of a portion of the sewing machine of FIG. 1 showing a thread cassette inserted within the cover before it is rotated upward to engage the thread handling instrumentalities.

Shown in FIG. 5 is a release spring 82 which extends from the rear surface of the chamber and which is biased outwardly from the chamber 46 to exert a force against the cassette 32 when the cover 34 is in its closed position. The release spring 82 acts to eliminate vibration of the cassette 32 within the cover 34 and forces the cassette 32 and cover 34 outwardly from the arm 14 when the release button 44 is depressed, as for example, when it is desired to change cassettes. FIG. 5 shows that located adjacent to the position of the cassette 32 when the cover 34 is in its closed position are a plurality of thread handling instrumentalities which include a check spring 84, a thread tension member 86, and a thread take-up 88. The thread tension member 86 is located in the path of the span of thread 64 from the second leg 62 to the first leg 60 of the cassette 32, and engages the thread between a set of tension discs 90 and 92. The tension discs 90 and 92 impart a frictional force to passage of the thread in timed relation to the reciprocation of the needle bar in a well known manner, and prevent the thread from becoming unwound from the thread supply 48 during the stitch setting process. The tension member 86 is accommodated in a cavity 94 formed in the thread cassette 32 intermediate leg 60 and leg 62 when the cover 34 is locked against the arm 14. The check spring 84 imparts a force against the thread directed outwardly from the chamber 46 and aids in controlling slack thread between the take-up 88 and the loop taker. A cavity 96 is formed within the thread cassette 32 adjacent the first leg 60 to accommodate the check spring 84 which is shown fastened to the sewing machine with a screw 98. The thread take-up 88, which is best shown in FIG. 4, reciprocates in timed relation to the reciprocation of the needle bar 18 and functions to control the slack thread when the loop of needle thread is shed from the loop taker during the well known process of setting a lockstitch. The take-up 88 preferably has a thread engaging beak 100 with a rounded deflecting surface 102 which engages and retains a thread portion 104 extending between the first leg 60 of the cassette 32 and the guide 76 during the upward excursion of the take-up 88. FIG. 3 best illustrates that the cover 34 has a take-up passageway 106 which is an extension of the thread passageway 78 and which is formed between a side wall of the cover 34 and the cassette 32 to permit the take-up 88 to reciprocatorily pass therethrough.

Figure 7:
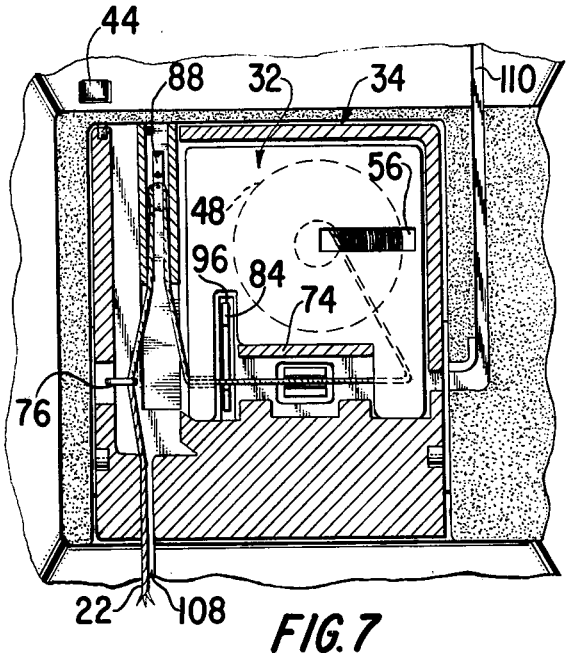
FIG. 7 is a front section view of a portion of FIG. 6 showing a thread supply cassette loaded in the sewing position.
Figure 6:
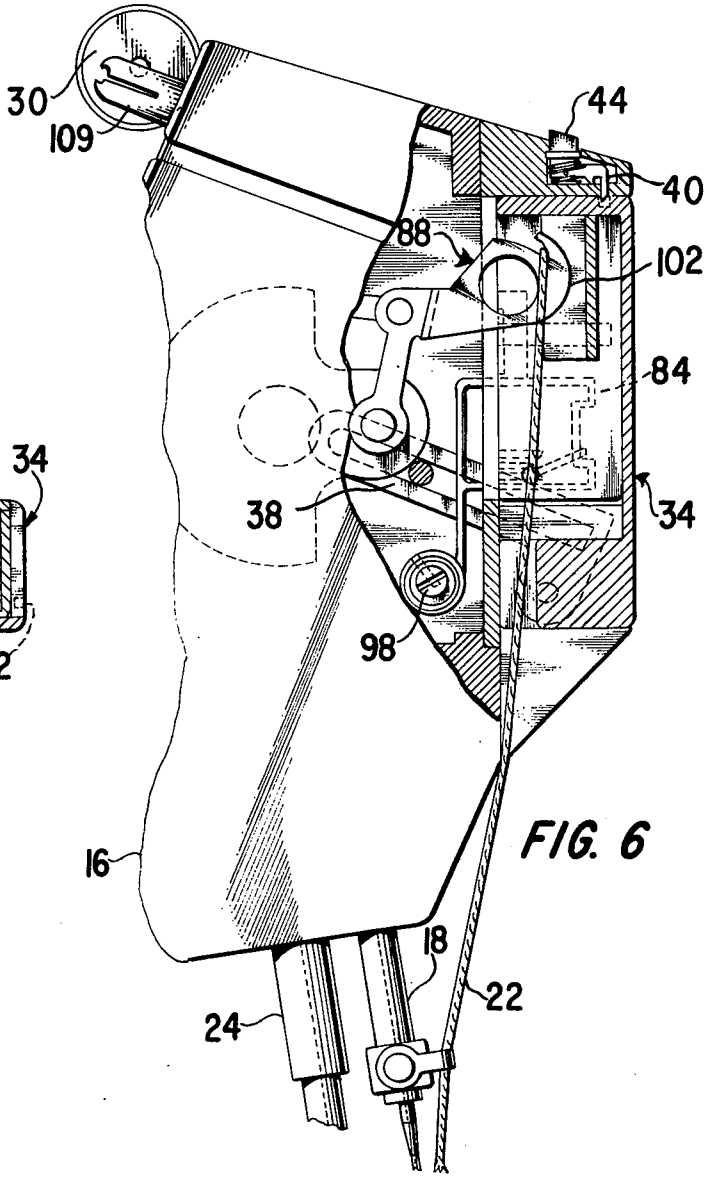
FIG. 6 is a view similar to FIG. 4 showing how the thread take-up cooperates with the thread from the thread cassette when the cover is in the closed position.

A sewing machine having a cassette threading system constructed in accordance with the teachings of this invention is prepared for sewing by placing a cassette 32 containing a supply of thread 48 within the cassette accommodating chamber 70 of the cover 34 as shown in FIG. 4. The free extremity of the thread 22 extending from the aperture 66 of the first leg 60 is passed around the guide 76 and then led through the passageway 78 and a thread accommodating slot 108 formed in the sewing head 16 to the needle 20 where it may be threaded in a conventional manner. When the cover 34 is rotated upwardly against the arm 14, the latch member 40 engages the aperture 42 to hold the cover 34 in a closed position. The release spring 82 presses against the cassette 32 to locate it against the cover 34. The thread span 68 is engaged by the tension discs 90 and 92 of the tension member 86. The check spring 84 engages the thread 68 between the tension member 86 and the first leg 60 of the cassette 32. The deflecting surface 102 of the thread take-up 88 deflects the thread away therefrom during its first downward excursion after the cassette 32 has been installed and engages and restrains the thread within its thread engaging beak 100 as shown in FIG. 6 during its upward excursion. It will be appreciated after a review of FIG. 7 that the reciprocatory motion of the take-up 88 within the passageway 106 will permit excess thread which is shed from the loop taker to be drawn safely upward and away from the loop taker, thereby precluding the production of an improper stitch, with the tension member 86 insuring that thread is not pulled from the thread supply 48 during the upward excursion of the take-up 88.

When the thread supply 48 contained within a cassette 32 has been expended, or when it is desired to change the color or type of thread, the cover release button 44 may be depressed and the cover 34 rotated forwardly by the pressure of the release spring 82 against the cassette 32. The unwanted cassette 32 may then be removed and a new cassette 32 installed.

Figure 8:
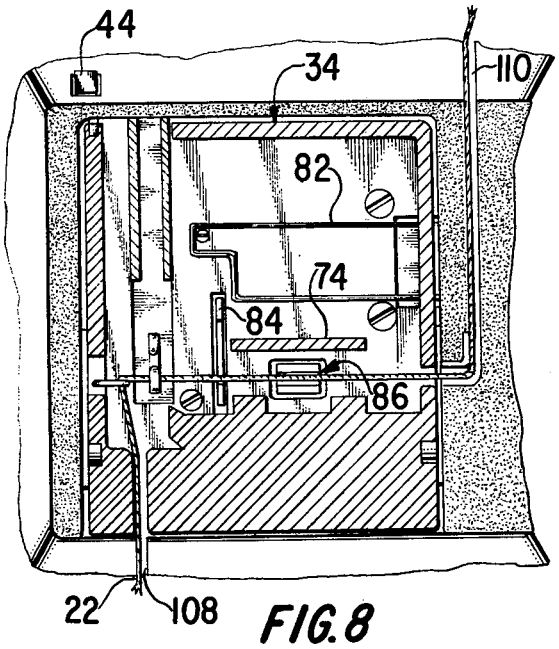
FIG. 8 is a view similar to FIG. 7 showing how thread supplied from an external spool (not shown) may be threaded through the cover to engage the thread handling instrumentalities of the sewing machine.

The disclosed invention herein described also permits a conventional spool of thread to serve as the thread supply. The spool is retained on the spool holder 30 in any conventional manner as for example by a frictional fit between the holder and an axial bore contained in the spool. The thread from the spool is led through a guide 109 on the back of the arm 14 and into a thread accommodating slot 110 formed on the arm adjacent the cover 34. FIG. 3 best shows that the cover 34 has an aperture 112 formed on one side thereof which will accommodate a thread exiting from the thread accommodating slot 110. The thread accommodating passageway 110 and the aperture 112 and guide 76 form a means defining a guided path for directing thread from a thread supply carried exteriorily on a spool, successively to the thread manipulating elements of the sewing machine. Since the cover 34 will not contain a cassette 32 when an external thread supply is used, the thread may be directly led between the aperture 112 and the guide 76 contained on the opposite wall of the cover 34. It may be seen from FIG. 8 that when the cover 34 is rotated upwardly against the arm 14, the thread retained between the aperture 112 and the guide 76 will engage the tension member 86 and the check spring 84. The thread engaging beak 100 of the take-up 88 will engage the thread during its first upward excursion since it is supported in the reciprocatory path of the beak 100 between the aperture 112 and the guide 76. Sewing may thereafter proceed using an external thread supply as if a cassette 32 were employed as the source of thread.

The cassette threading arrangement disclosed herein is especially advantageous when frequent changes of thread are necessitated due to the desire to incorporate different colors or weights of thread in a sewing project. With a number of cassettes having different colors and weights of thread it is a simple task to remove one cassette and replace it with another cassette containing the desired color or weight of thread. If a sewer does not have a cassette containing the proper color or type of thread available, she may use an appropriate spool of thread with a minimal additional effort required to lead the thread through the slot 110 and the aperture 112.

It will be appreciated that modifications and variations of the described invention may become evident to one skilled in the art in light of the above teachings. However, it is to be understood that the present disclosure relates to but one preferred embodiment which is for the purpose of illustration only, and should not be construed as a limitation on the scope of the invention. All such modifications which do not depart from the spirit of the invention are intended to be included within the scope of the appended claims.

We claim:

1. A sewing machine cassette threading system for supplying thread to a sewing machine having an arm, a spool holder mounted on said arm, a thread carrying stitch forming instrumentality, and thread manipulating elements associated with said stitch instrumentality carried in said arm, said cassette threading system comprising a cassette accommodating chamber formed in said arm having said thread manipulating elements located in said chamber, a first thread accommodating slot formed in said arm to provide a passageway for thread from said chamber to said thread carrying stitch forming instrumentality and a second thread accommodating slot defining a passageway for thread from said spool holder to said chamber in said arm, said second slot having an extremity terminating at said chamber, whereby said thread carrying stitch forming instrumentality may be threaded selectively from a spool of thread carried in said spool holder or from a thread supply contained in a cassette.

2. The sewing machine cassette threading system recited in claim 1 wherein said sewing machine arm has a cover hingedly fastened to said arm for enclosing said cassette accommodating chamber, a cassette having provision for housing a cassette thread supply and including means for guiding thread from said cassette thread supply in at least one free span, said cover receiving said cassette and positioning said at least one free span of thread from said cassette against said thread manipulating elements when said cover encloses said cassette accommodating chamber.

3. The sewing machine cassette threading system recited in claim 2 wherein said cover has formed adjacent to an extremity of said second thread accommodating slot an aperture for accepting thread led from a spool carried on said spool holder on said arm, and a thread guide located on said cover adjacent to said first thread accommodating slot, whereby a free span of thread is formed on said cover between said aperture and said thread guide, said free span of thread being shifted into engagement with said thread manipulating elements when said cover encloses said cassette accommodating chamber.

4. The sewing machine cassette threading arrangement recited in claim 3 further comprising a release spring fastened within said cassette accommodating chamber and a locking mechanism for retaining said cover of said cassette accommodating chamber against said arm, said release spring biasing said cover away from said arm when said locking mechanism is disengaged from said cover.

* * * * *